US008500394B2

(12) United States Patent
Major et al.

(10) Patent No.: US 8,500,394 B2
(45) Date of Patent: Aug. 6, 2013

(54) SINGLE CHANNEL INNER DIAMETER SHROUD WITH LIGHTWEIGHT INNER CORE

(75) Inventors: Daniel W. Major, Middletown, CT (US); William J. Speers, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 1343 days.

(21) Appl. No.: 12/070,626

(22) Filed: Feb. 20, 2008

(65) Prior Publication Data

US 2009/0208338 A1 Aug. 20, 2009

(51) Int. Cl.
*F01D 9/00* (2006.01)

(52) U.S. Cl.
USPC ..... 415/160; 415/209.3

(58) Field of Classification Search
USPC .. 415/173.7, 170.1, 160, 209.3, 215; 416/215
See application file for complete search history.

(56) References Cited

U.S. PATENT DOCUMENTS

| | | | | |
|---|---|---|---|---|
| 4,076,451 | A | 2/1978 | Jankot | |
| 4,395,195 | A * | 7/1983 | De Cosmo et al. | 415/137 |
| 4,655,682 | A | 4/1987 | Kunz et al. | |
| 4,792,277 | A | 12/1988 | Dittberner, Jr. et al. | |
| 4,834,613 | A | 5/1989 | Hansen et al. | |
| 5,062,767 | A * | 11/1991 | Worley et al. | 415/209.3 |
| 5,346,362 | A | 9/1994 | Bonner et al. | |
| 5,352,087 | A | 10/1994 | Antonellis | |
| 5,380,152 | A * | 1/1995 | Sikorski et al. | 415/160 |
| 5,380,155 | A | 1/1995 | Varsik et al. | |
| 5,421,703 | A | 6/1995 | Payling | |
| 5,462,403 | A | 10/1995 | Pannone | |
| 5,482,433 | A | 1/1996 | Norris et al. | |
| 6,059,525 | A | 5/2000 | Jiomacas et al. | |
| 6,129,512 | A * | 10/2000 | Agram et al. | 415/160 |
| 6,402,466 | B1 | 6/2002 | Burdgick et al. | |
| 6,435,820 | B1 | 8/2002 | Overberg | |
| 6,481,960 | B2 | 11/2002 | Bowen | |
| 6,814,538 | B2 | 11/2004 | Thompson | |
| 6,821,085 | B2 | 11/2004 | Darkins, Jr. et al. | |
| 6,843,638 | B2 | 1/2005 | Hidalgo et al. | |
| 6,863,495 | B2 | 3/2005 | Halliwell et al. | |
| 6,884,026 | B2 | 4/2005 | Glynn et al. | |

(Continued)

FOREIGN PATENT DOCUMENTS

| | | | |
|---|---|---|---|
| EP | 1524412 | A2 | 4/2005 |
| EP | 1760272 | A2 | 3/2007 |
| WO | WO 2007/077183 | A1 * | 7/2007 |

OTHER PUBLICATIONS

The Apr. 4, 2012 European Search Report for European Application No. 09250452.1.

*Primary Examiner* — Nathaniel Wiehe
*Assistant Examiner* — Joshua R Beebe
(74) *Attorney, Agent, or Firm* — Kinney & Lange, P.A.

(57) ABSTRACT

An inner diameter shroud for receiving an inner diameter base portion of a rotatable vane in a gas turbine engine has a single piece channel and a core. The channel has a leading edge wall, an inner diameter wall, a trailing edge wall, a radial outer surface, and at least two axial projections. The axial projections prevent radial movement of the core. The core has an outer radial surface that generally aligns with the radial outer surface of the channel. The core is movable in the channel in a circumferential direction and is configured to rotatably retain the inner diameter base portion of the rotatable vane.

17 Claims, 9 Drawing Sheets

U.S. PATENT DOCUMENTS

| | | | | |
|---|---|---|---|---|
| 6,910,854 | B2 | 6/2005 | Joslin | |
| 6,932,566 | B2 * | 8/2005 | Suzumura et al. | 415/135 |
| 2003/0170115 | A1 * | 9/2003 | Bowen et al. | 415/160 |
| 2005/0220612 | A1 | 10/2005 | Jahns et al. | |
| 2007/0059161 | A1 * | 3/2007 | Bouru | 415/160 |
| 2007/0237631 | A1 * | 10/2007 | Lytle | 415/191 |
| 2009/0016889 | A1 * | 1/2009 | Krutzfeldt et al. | 416/204 R |

* cited by examiner

SINGLE CHANNEL INNER DIAMETER SHROUD WITH LIGHTWEIGHT INNER CORE

BACKGROUND

The present invention relates to a gas turbine engine shroud, and more particularly to an inner diameter shroud that has a single exterior channel and a lightweight core.

In the high pressure compressor section of a gas turbine engine, the inner diameter shroud protects the radially innermost portion of the vanes from contact with the rotors 12, and creates a seal between the rotors and the vanes. Typically, the inner diameter shroud is a clam shell assembly comprised of two shroud segments, a clamping bolt, and a clamping nut. The bolt fastens to the nut through the two shroud segments. Turbine engine inner shroud average diameters typically range from 18 to 30 inches (475 mm to 760 mm) in diameter. This diameter, coupled with dynamic loading and temperatures experienced by the shroud during operation of the turbine engine, require the use of at least a #10 bolt (0.190 inches, 4.83 mm, in diameter) in the conventional clam shell assembly. The #10 bolt prevents scalability of the shroud assembly because the shroud must be a certain size to accommodate the bolt head, corresponding nut and assembly tool clearance. Thus, the radial height, a measure of the inner shroud's leading edge profile, typically approaches 1 inch (25.4 mm) with the conventional clam shell shroud. The excessive radial height of the clam shell configured shroud diminishes the compressor efficiency, increases the weight of the shroud, and potentially negatively impacts the weight-to-thrust performance ratio of the turbine engine.

SUMMARY

An inner diameter shroud for receiving an inner diameter base portion of a rotatable vane in a gas turbine engine has a single piece channel and a core. The channel has a leading edge wall, an inner diameter wall, a trailing edge wall, a radial outer surface, and at least two axial projections. The axial projections prevent radial movement of the core. The core has an outer radial surface that generally aligns with the radial outer surface of the channel. The core is movable in the channel in a circumferential direction and is configured to rotatably retain the inner diameter base portion of the rotatable vane.

DETAILED DESCRIPTION

Figure 1:
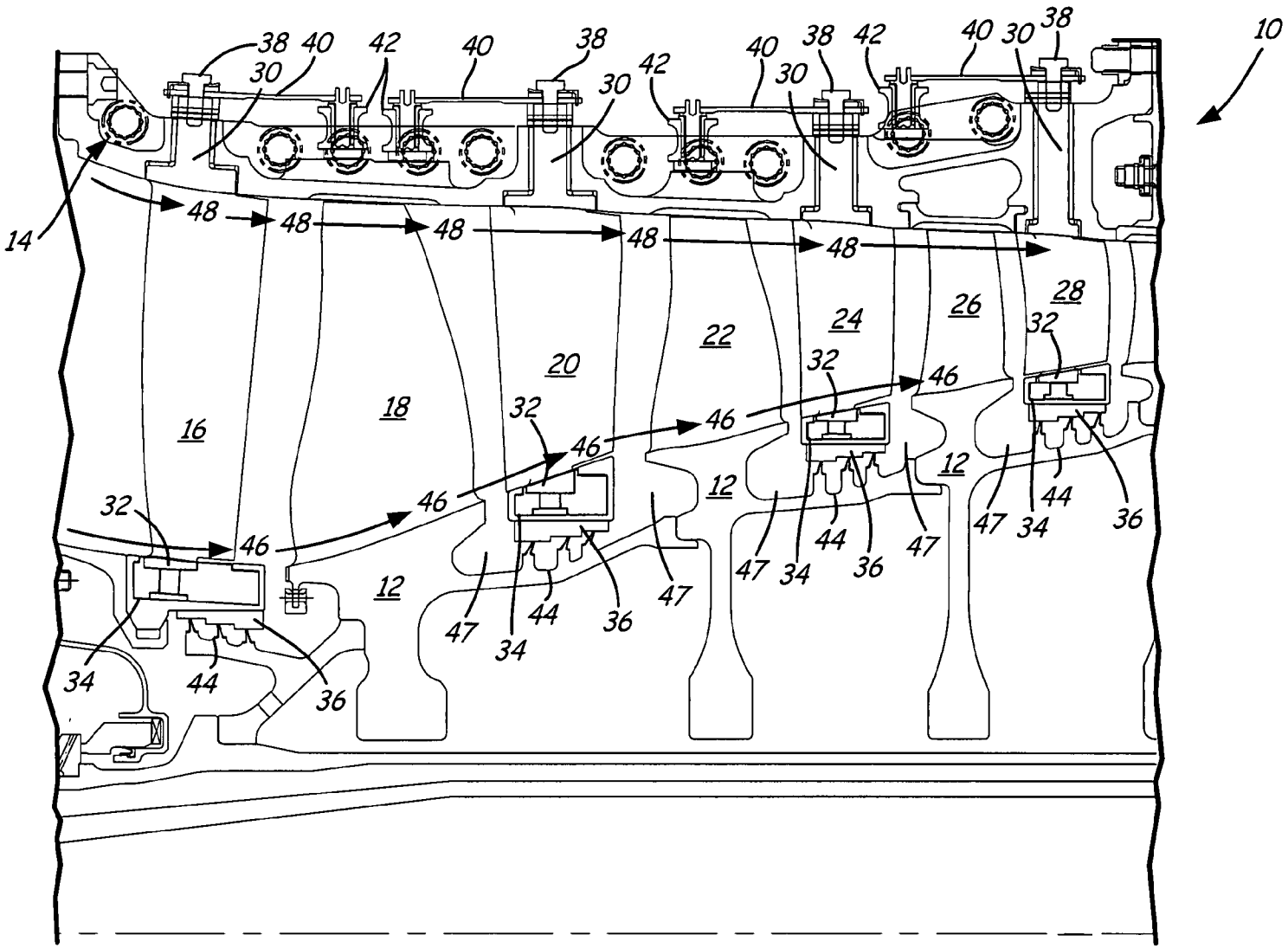
FIG. 1 is a partial sectional view of a compressor section for a gas turbine engine.

FIG. 1 is a partial sectional view of a compressor section for a gas turbine engine 10 that includes a rotor 12, a case 14, a variable inlet guide vane 16, a first stage rotor blade 18, a first stage variable vane 20, a second stage rotor blade 22, a second stage variable vane 24, a third stage rotor blade 26, and a third stage variable vane 28. Each of the vanes 16, 20, 24, 28 includes an outer diameter trunnion 30, an inner diameter base portion 32, an inner diameter shroud 34. The inner diameter shroud 34 includes radially inward facing inner diameter air seal 36. Connected to each outer diameter trunnion 30 is a vane positioning mechanism that includes a fastener 38, an actuating arm 40, and a unison ring 42. The rotor 12 includes knife edge seals 44 positioned opposite each of the inner diameter air seals 36 to create a leakage restriction.

FIG. 1 shows the compressor section for gas turbine engine 10 with a rotor 12 carrying a plurality of stages of rotor blades 18, 22, 26. The rotor 12 acts dynamically on air flow entering the compressor section. The rotor 12 includes an arcuate array of knife edge seals 44 that act with the inner diameter air seals 36 to cut off secondary flow around the rotor 12. Thus, the base of the rotor blades 18, 22, 26 and the inner diameter shrouds 34 define an inner diameter flow path 46, which axially directs compressed air flow through the compressor section.

In FIG. 1, the case 14 defines an outer diameter flow path 48 for the air flow in the compressor section. The case 14 uses fasteners 38 to interconnect with the outer diameter trunnion 30 on the vane stages 16, 20, 24, 28. The vane stages 16, 20, 24, 28 are stationary but act on the air flow by directing flow incidence impinging on subsequent rotating blades in the compressor section. The vane stages 16, 20, 24, 28 direct the flow incidence simultaneously via the unison ring 42. The unison ring 42 interconnects with the actuating arm 40, which is engaged to the interconnecting surface of the trunnion 30. The fastener 38 secures the vane arm 40, which pivots the vane stages 16, 20, 24, 28 about the axes of the outer diameter trunnions 30. The vanes 16, 20, 24, 28 also pivot about an axes of the inner diameter base portions 32 within the inner diameter shrouds 34. This allows the inner diameter shrouds 34 and the inner diameter air seals 36 to remain stationary during the pivoting of the vane stages 16, 20, 24, 28. The stationary inner diameter shrouds 34 and the inner diameter air seals 36, along with the dynamic rotor 12, define the inner diameter flow path 46. Compression cavities 47 adjacent the leading and trailing edge of the inner diameter shrouds 34 create a clearance between the shrouds 34 and air seals 36, and the rotor 12 and rotor blades 18, 22, 26.

Figure 2:
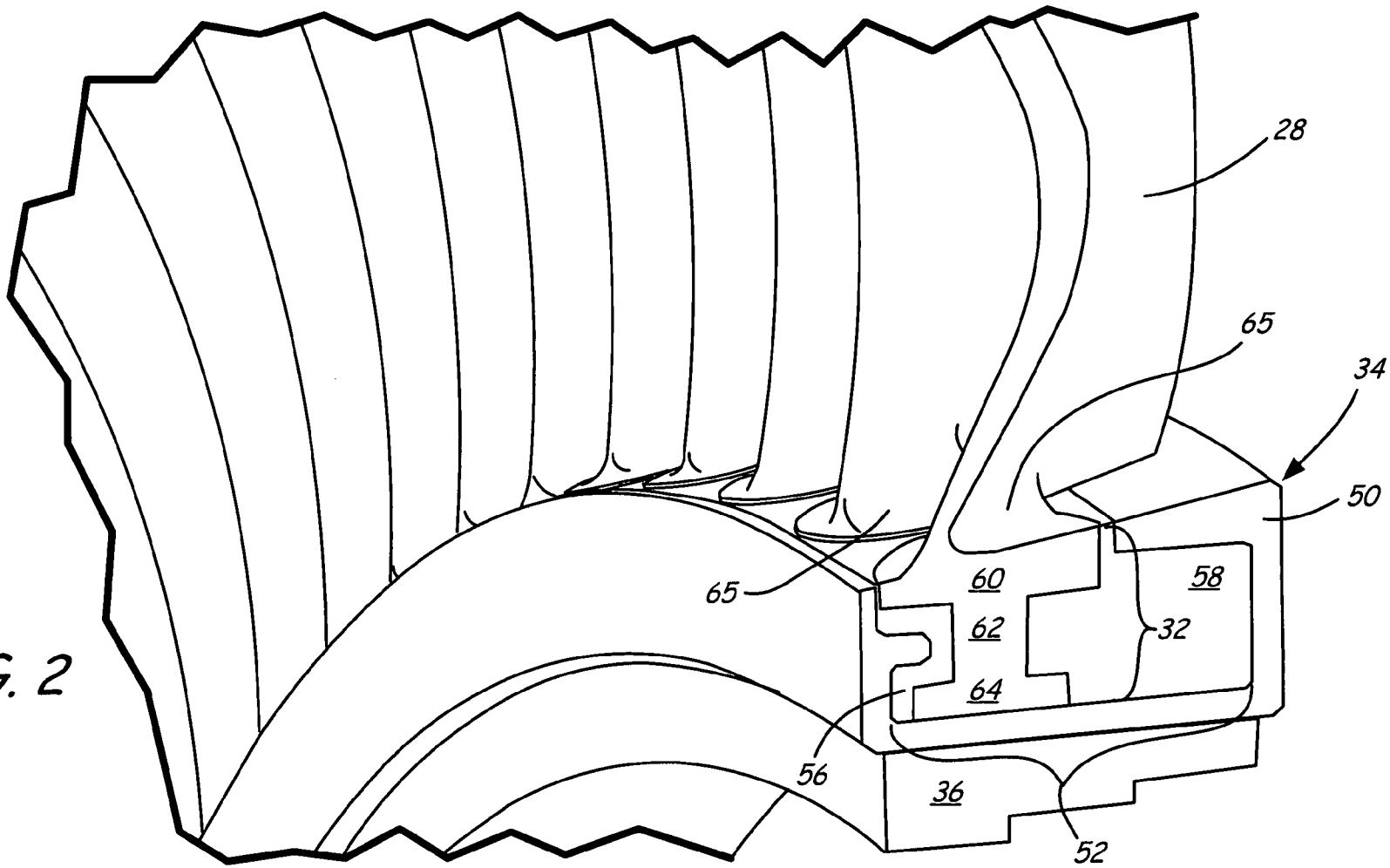
FIG. 2 is a sectional view of a shroud assembly according to an embodiment of the present invention bisecting a vane.
Figure 3:
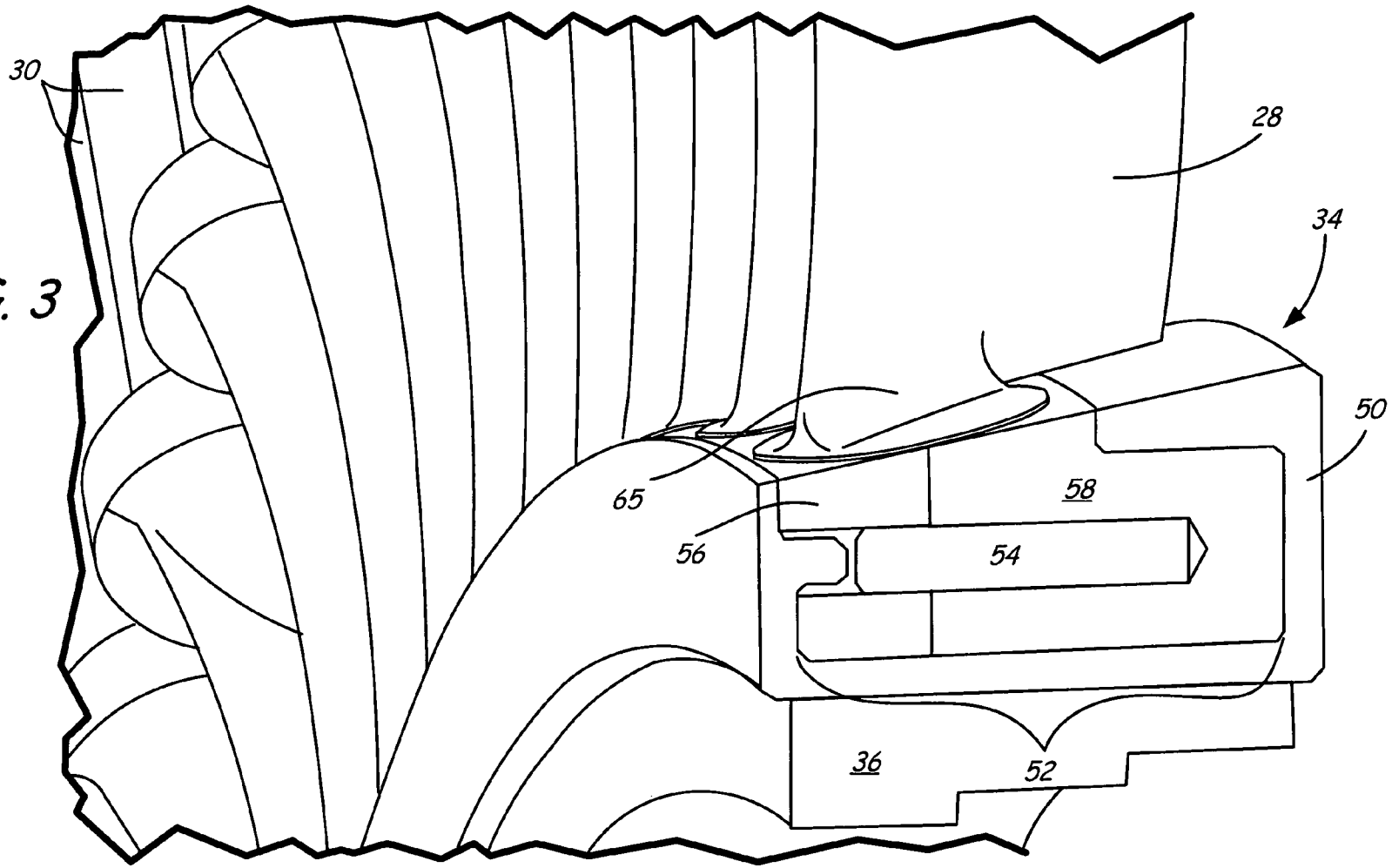
FIG. 3 is a sectional view of the shroud assembly of FIG. 2 bisecting a dowel pin.

FIGS. 2 and 3 show sectional views of inner diameter shroud 34. The shroud 34 is arcuate in shape and includes various components in addition to the inner diameter air seal 36. These components include a channel 50, a core 52, and a dowel pin 54. The core 52 further includes a leading segment 56 and a trailing segment 58. The vanes 16, 20, 24, 28 (for convenience 28 will be used in FIGS. 2 through 8) and the inner diameter base portion 32 are illustrated in FIG. 2. The inner diameter base portion 32 includes an inner diameter platform 60, an inner diameter trunnion 62, and a trunnion flange 64.

FIGS. 2 and 3 show a cross section of the channel 50. The channel 50 is formed of a single piece metal alloy. In one embodiment of the channel 50, the metal alloy is 410 stainless steel. The channel 50 is arcuately bowed, and several channel 50 segments may be circumferentially aligned and interconnected around the inner diameter of the compressor section. In one embodiment of the channel 50, each channel 50 segment extends through an arc of substantially 90 degrees in one embodiment. Once interconnected, the channel 50 segments may be less than about 14 inches (355 mm) in diameter. The channel 50 envelops most of the core 52 and the other components of the shroud 34. The channel 50 has an external surface(s) that interfaces with the inner diameter flow path 46. In FIGS. 2 and 3, an external surface of the channel 50 has the inner air seal 36 mechanically bonded to it by welding, brazing or other bonding means. The inner air seal 36 forms a seal between the channel 50 and the knife edge seals 44. In one embodiment, the inner air seal 36 is a conventional honeycomb nickel alloy seal.

The channel 50 envelopes, protects and therefore minimizes exposed surfaces of components 56 and 58 from particle ingested abrasion along inner diameter flow path. Because the channel 50 envelops most of the core 52 and the other components of the shroud assembly 34, the channel 50 captivates the other components should they wear or break due to extreme operating conditions. Thus, the worn component pieces do not enter the flow path to damage components of the gas turbine engine 10 downstream of the shroud 34. The single piece channel 50 eliminates the need for fasteners to retain the core 52 and vane 28 in the shroud 34. Thus, the radial height profile of the shroud 34 may be reduced. This reduction increases compression efficiency and decreases the size and overall weight of shroud assembly 34, improving turbine engine 10 performance.

FIGS. 2 and 3 also show a cross section of the core 52. The core 52 is a lightweight material, and may be comprised of either a metallic or a non-metallic. For example, a metallic such as AMS 4132 aluminum, or non-metallic such as graphite or a composite matrix comprised of random fibers, laminates or particulates may be used in embodiments of the invention. The core 52 is sacrificial and disposable and may be replaced after a certain number of engine cycles. The core 52 surrounds and is retained axially, circumferentially, and radially by the base portion 32 of the vane 28. The core 52 interfaces with and is retained by the channel 50 in multiple directions including both the radial and axial directions. A surface (or multiple surfaces if the core 52 is split) of the core 52 interfaces with the inner diameter flow path 46 around the base portion 32 of the vane 28. The surface(s) of the core 52 may substantially align with an inner exterior surface(s) of the channel 50 to define the inner diameter flow path 46 annulus for the compressor section of the gas turbine engine 10.

In FIGS. 2 through 8, the core 52 may be split into the leading segment 56 and the trailing segment 58 along a plane defined by an actuation axes of the inner diameter base portion 32 of the vane 28. This split allows each portion 56, 58 to symmetrically surround half of the base portion 32. The portions 56, 58 are split to ease assembly and repair of the shroud 34. In other embodiments of the core, the core may not be split into portions or may be split into portions that are not separated along a plane defined by the actuation axes of the base portion 32.

FIG. 2 is a sectional view bisecting the inner diameter base portion 32 of the vane 28. The vane 28 and base portion 32 may be comprised of any metallic alloy such as PWA 1224 titanium alloy. The vane 28 interconnects with the base portion 32. The base portion 32 includes the inner diameter platform 60, which interfaces with the leading segment 56 and the trailing segment 58 of the core 52. The exterior portion of the inner diameter platform 60 has a fillet 65 for aerodynamically interconnecting the inner diameter platform 60 with the vane 28. The exterior portion of the inner diameter platform 60 may substantially align with the exterior surfaces of the leading segment 56 and the trailing segment 58 of the core 52 to create an aerodynamic profile along the inner diameter flow path 46.

The inner diameter platform 60 interconnects with the inner diameter trunnion 62, which interfaces with and circumferentially retains (in addition to the dowel pin(s) 54) the leading segment 56 and the trailing segment 58. The inner diameter trunnion 62 allows the vane 28 to pivot about an axis defined by the trunnion 62, while the shroud 34 remains stationary. The inner diameter trunnion 62 interconnects and symmetrically aligns with the trunnion flange 64. The trunnion flange 64 may interface with the channel 50. The trunnion flange 64 interfaces with the leading segment 56 and the trailing segment 58.

FIG. 3 is a sectional view bisecting the dowel pin 54. The pins 54 may be made of a metallic or a non-metallic material. The pins 54 may be of any shape, length or thickness; the shape, length and thickness may vary as dictated by the operating conditions of the turbine engine 10. The pins 54 fit into a bore to interconnect the leading segment 56 with the trailing segment 58. The pins 54 may also be used to align the leading segment 56 with the trailing segment 58 during assembly of the core 52. The pins 54 may be selectively placed in the core 52. If a greater vane 28 and shroud 34 stiffness is required for a particular application, the pins 54 may be placed between each base portion 32. Alternatively, a fastener or some other means of interconnecting the leading segment 56 and the trailing segment 58 may be used in lieu of the pins 54.

Figure 4:
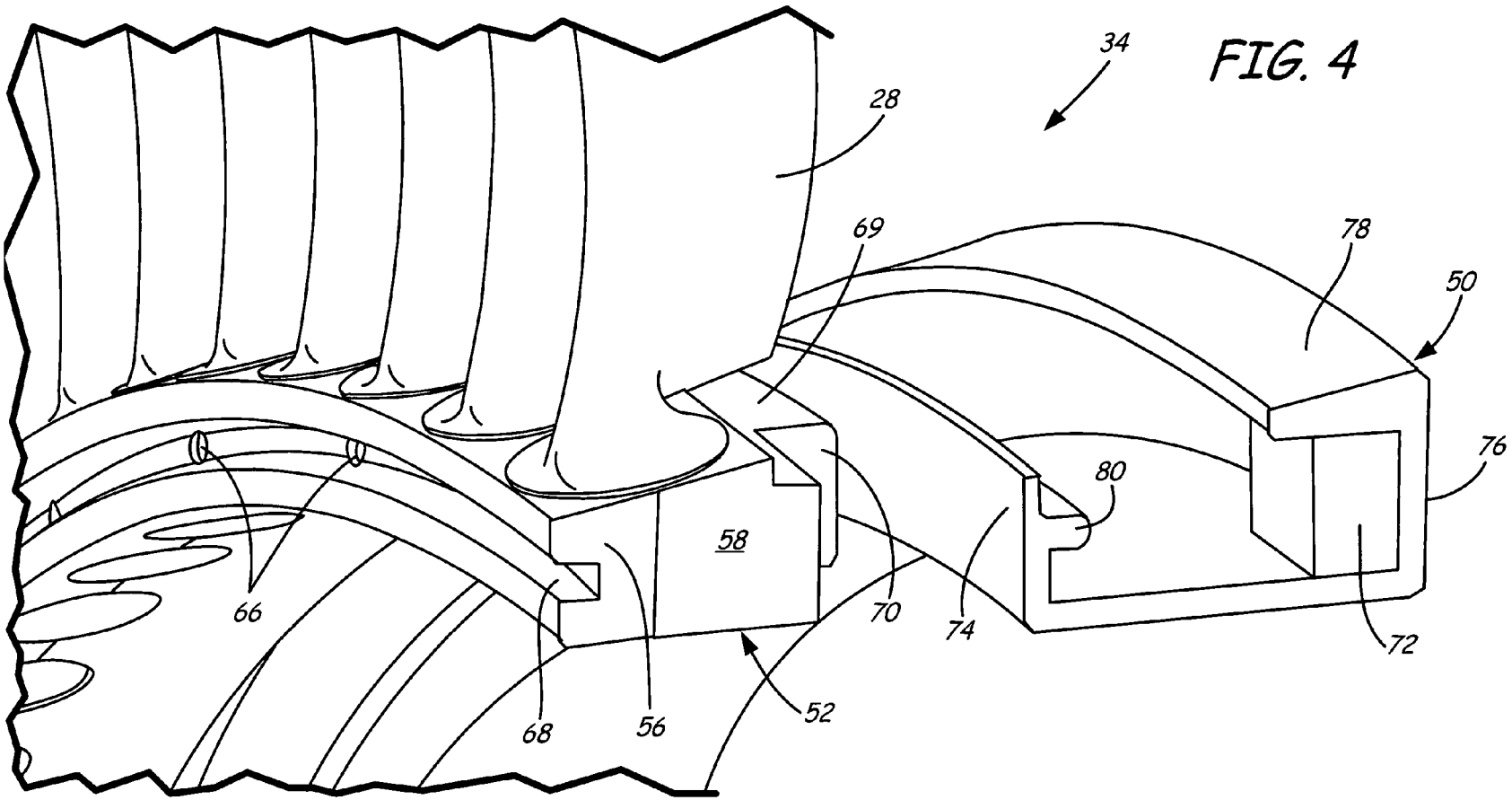
FIG. 4 is an exploded end view of the shroud assembly of FIG. 2 showing a core containing a vane and a channel with an inner air seal removed.

FIG. 4 shows an exploded end view of the shroud assembly 34 including the assembled core 52 retaining the vanes 28, and the channel 50. In addition to the leading segment 56 and the trailing segment 58, the core 52 includes a hole 66, a retention groove 68, a recessed surface 69, and an anti-rotation notch 70. The channel 50 includes an anti-rotation lug 72, a leading edge surface 74, a trailing edge surface 76, a trailing edge lip 78, and an interior retention railhead 80.

With a split core 52, the shroud assembly 34 may be assembled by sliding the circumferential arcuate channel 50 segments along the retention groove 68 and the retention track 69 of the core 52. In the embodiment shown FIG. 4, the core 52 may be assembled by aligning the leading segment 56 and the trailing segment 58 around the base portion 32 (shown in FIG. 2) of the vanes 28. The dowel pins 54 may than be inserted through select thru holes 66 in the leading segment 56 to the depth required to engage both the leading segment 56 and the trailing segment 58. The hole 66 is radially located along the retention groove 68 on the leading segment 56. The hole 66 may be between each of the base portions 32 of the vanes 28 or may be selectively arrayed as engine operating criteria dictate. Alternatively, to assemble the core 52 the dowel pins 54 may be placed into or mechanically bonded with select bore holes in the trailing segment 58. In another embodiment, the dowel pins 54 may also be bonded to the leading segment 56. In yet another embodiment, the hole 66 may be blind or thru on either segment 56 or 58 or any combination thereof. The hole 66 on the leading segment 56 may then be aligned with and inserted onto the dowel pins 54 to complete assembly of the core 52. The hole 66 also allows for service access to check wear in the interior of the core 52. In FIG. 4, the assembled core 52 is substantially 60 degrees in circumferential length, and may be abuttably interfaced with additional cores 52 or core portions along the circumferential length of the channel 50. Cores 52 or core portions of differing degrees of circumferential length may be used in other embodiments, and the core 52 or core portions circumferential length may vary depending on manufacturing and operating criteria. Circumferential movement of the channel 50 may be arrested by an anti-rotation lug 72 contacting the anti-rotation notch 70. The anti-rotation lug 72 is brazed or mechanically bonded to the trailing edge 78 near the circumferential edges of the channel 50. In one embodiment, the anti-rotation notch 70 occurs only on the cores 52 interfacing the circumferential edges of the channel 50.

Once the core 52 is assembled the channel 50 is inserted over the core 52. The channel 50 is movable along the circumferential length of the core 52 until the movement is arrested by an anti-rotation lug 72 contacting the anti-rotation notch 70. In one embodiment of the invention, the core 52 has a clearance of about 0.003 inch (0.076 mm) between its outer edges and the inner edges of the channel 50. The core 52 may be comprised of a material that has a greater coefficient of thermal expansion than the channel 50. The clearance between the channel 50 and the core 52 is reduced to about 0.0 inch (0 mm) at operating conditions. Thus, minimizing relative motion between mated core 52 and channel 50 and efficiency losses due to secondary flow leakage.

Once inside the channel 50, the retention groove 68 on the leading segment 56 interacts with the interior retention railhead 80 to allow slidable circumferential movement of the core 52. The interior retention railhead 80 retains the leading segment 56 and the trailing edge lip 78 retains the trailing segment 58 from movement into the inner diameter flow path 46 in the radial direction. The interior retention railhead 80 may captivate the lower portion of the leading segment 56 should it wear or break due to extreme operating conditions. The interior retention railhead 80 also allows the base portion 32 to be disposed further forward in the shroud 34 (closer to the leading edge surface 74 of the channel 50). This configuration increases compressor efficiency by reducing the leading edge gaps between the vane 28 and the case 14 (FIG. 1) along flow path 48 (FIG. 1) and the vane 28 and the shroud 34 (FIG. 1) along the inner diameter flow path 46. The forward axis of rotation of the vane 28, as shown in FIG. 4, ensures that the vane 28 will remain open in the event of actuation failure by, for example, the actuating arm 40 (FIG. 1) or the unison ring 42 (FIG. 1).

The channel 50 and core 52 fit eliminates the need to use a fastener to retain the core 52 to the channel 50, as the channel 50 retains the core 52 in multiple directions including the radial and axial directions. By eliminating the need for fasteners, the height of the leading edge surface 74 and the trailing edge surface 76 is reduced. This reduction in height reduces the radial height profile, as the height of the leading edge surface 74 is the radial height profile of the shroud 34. The height of the leading edge surface 74 may vary by the stage in the compressor section. However, by using the channel 50, the leading edge surface 74 may be reduced to a range from about 0.250 inch to about 0.330 of an inch (about 6.35 mm to about 8.47 mm) in height when a shroud 34 of less than about 14 inches (355 mm) in diameter is used. This reduction in height minimizes the compression cavities 47, (FIG. 1) thereby improving the compressor efficiency and decreasing the overall size and weight of shroud 34.

Figure 5A:
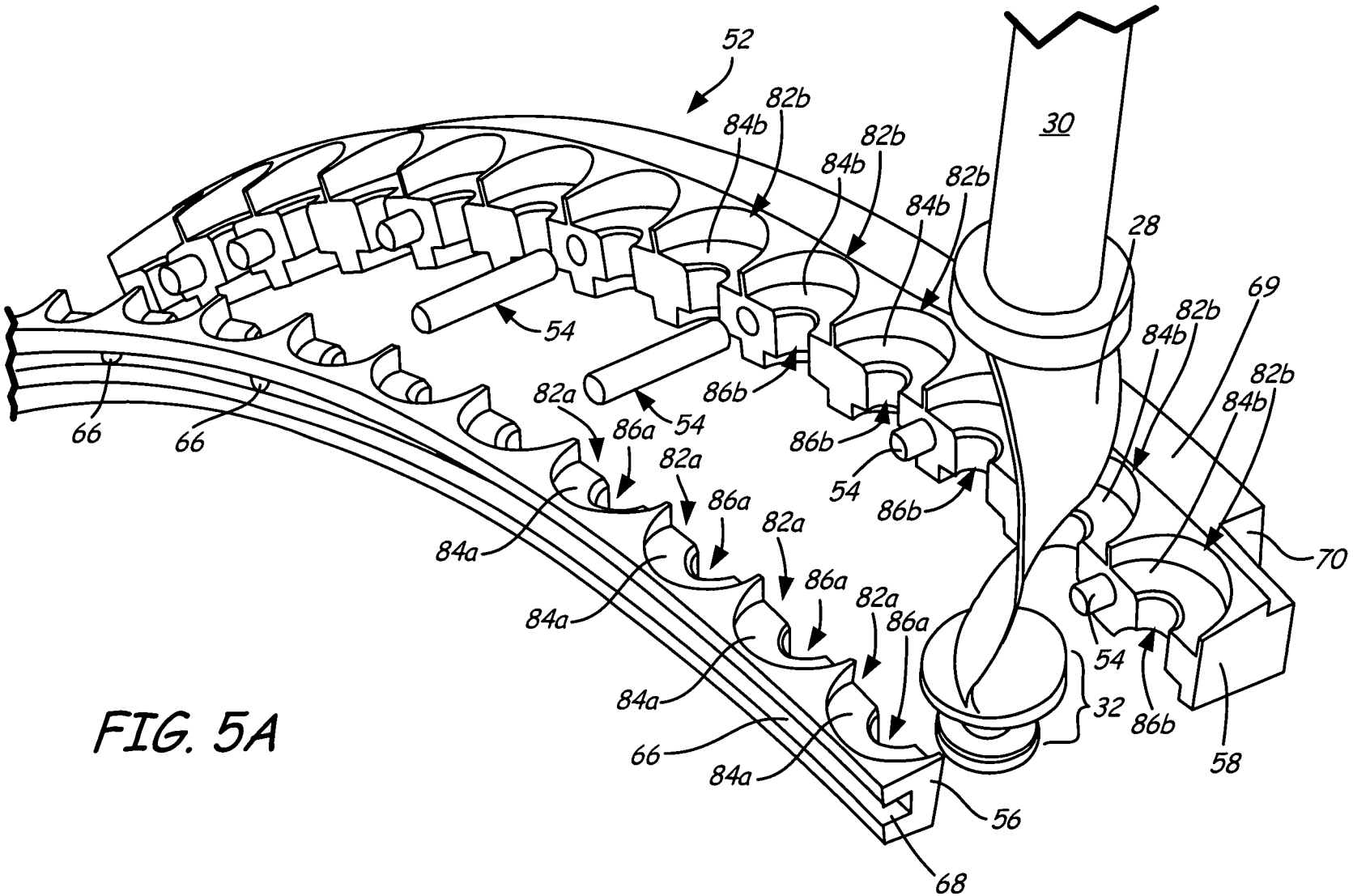
FIG. 5A is an exploded outer diameter view of the core of FIG. 4.
Figure 5B:
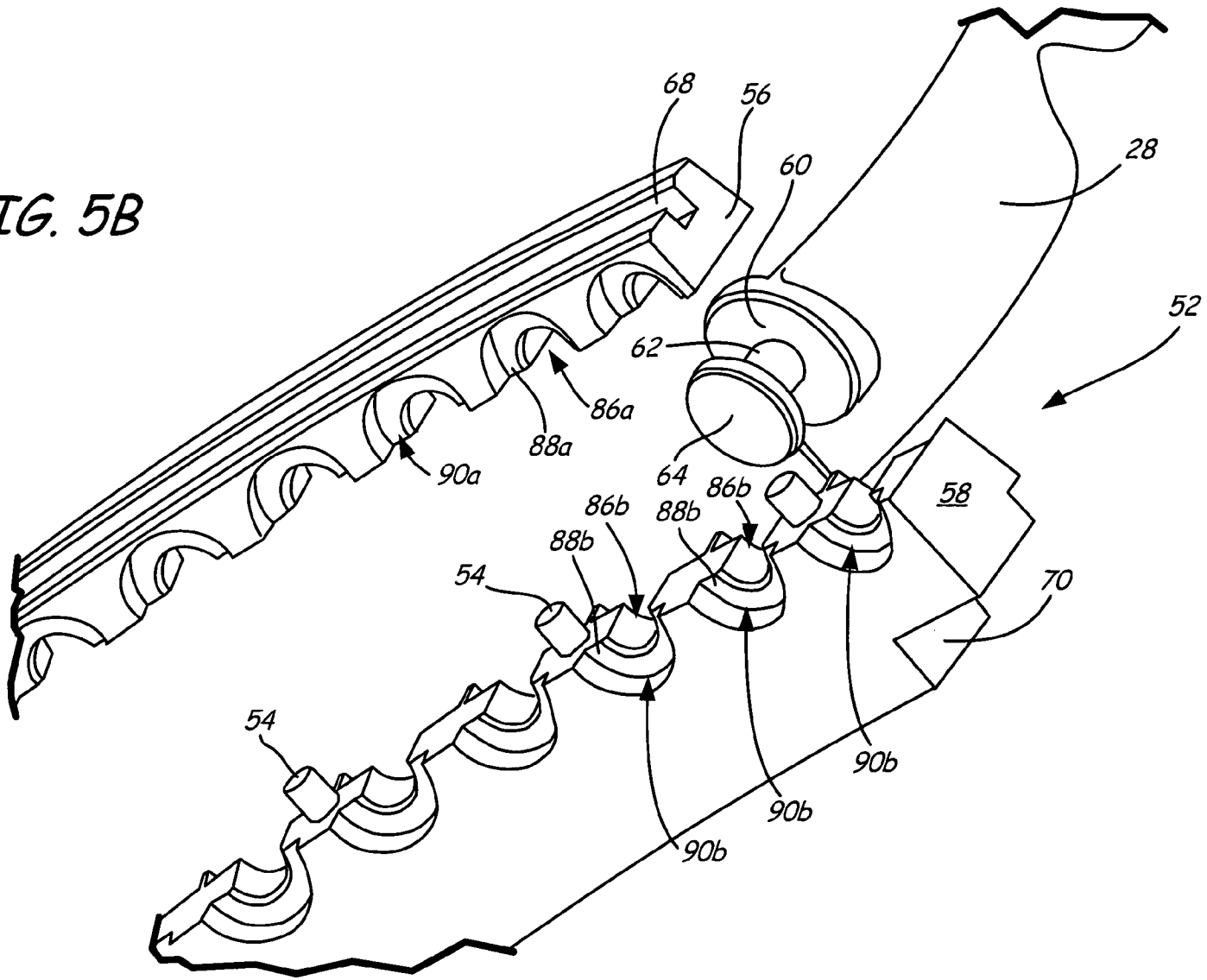
FIG. 5B is an exploded inner diameter view of the core of FIG. 4.

FIGS. 5A and 5B show exploded views of the core 52 with a vane 28 and dowel pins 54. In addition to the hole 66 and the retention groove 68, the leading segment 56 includes a first cylindrical opening 82*a*, a first thrust bearing surface 84*a*, a journal bearing surface 86*a*, a second thrust bearing surface 88*a*, and a second cylindrical opening 90*a*. The trailing segment 58 includes the anti-rotation notch 70, a first cylindrical opening 82*b*, a first thrust bearing surface 84*b*, a journal bearing surface 86*b*, a second thrust bearing surface 88*b*, and a second cylindrical opening 90*b*.

The core 52 illustrated in FIGS. 5A and 5B is comprised of a composite material and is symmetrically split about the axis of the inner diameter trunnion 62 into the leading segment 56 and the trailing segment 58; other embodiments of the invention may include a metallic core 52 or may not be split symmetrically. In FIG. 5A, the surfaces of the leading segment 56 and the trailing segment 58 interfacing with the inner diameter flow path 46 have symmetrically, circumferentially spaced first cylindrical openings 82*a*, 82*b*. The cylindrical openings 82*a*, 82*b* are symmetrically, axially split between the leading segment 56 and the trailing segment 58. The cylindrical openings 82*a*, 82*b* interface with the side surfaces of inner diameter platform 60 on the vanes 28. The cylindrical openings 82*a*, 82*b* provide a recess for the inner diameter platform 60, which allows the external surface of the platform 60 to be aerodynamically aligned with the external surface(s) of the core 52 along the inner diameter flow path 46. The cylindrical openings 82*a*, 82*b* have tolerances that allow the inner diameter platform 60 to pivot about its axis, which allows the vane 28 to pivot. The cylindrical openings 82*a*, 82*b* also may act as bearings during operation of the turbine engine 10.

In FIG. 5A, the cylindrical openings 82*a*, 82*b* transition to the first thrust bearing surfaces 84*a*, 84*b*. The thrust bearing surfaces 84*a*, 84*b* interface with the inner surface of the inner diameter platform 60. During operational use of the gas turbine engine 10, the vanes 28 transmit a thrust force into the first thrust bearing surfaces 84*a*, 84*b* via the inner surface of the inner diameter platform 60. The composite surfaces 84*a*, 84*b* act as a bearing for this thrust force.

The thrust bearing surfaces 84*a*, 84*b* interconnect with the journal bearing surfaces 86*a*, 86*b*. The thrust bearing surfaces 84*a*, 84*b* are symmetrically axially split on the leading segment 56 and the trailing segment 58, and interface around the inner diameter trunnion 62. The journal bearing surfaces 86*a*, 86*b* may act as a bearing surface for the inner diameter trunnion 62 during operational use. The journal bearing surfaces 86*a*, 86*b* have a tolerance that allows the inner diameter trunnion 62 to pivot around its axis, which allows the vane 28 to pivot. The thrust bearing surfaces 84*a*, 84*b* interconnect with the second thrust bearing surfaces 88*a*, 88*b*. The second thrust bearing surfaces 88*a*, 88*b* interface with a surface of the trunnion flange 64. During operational use of the gas turbine engine 10, the vanes 28 transmit a thrust force into the second thrust bearing surfaces 88*a*, 88*b* via the surface of the trunnion flange 64. The composite surfaces 88*a*, 88*b* act as a bearing for this thrust force.

The second thrust bearing surfaces 88*a*, 88*b* transition to the second cylindrical openings 90*a*, 90*b*. The cylindrical openings 90*a*, 90*b* are symmetrically axially split on the leading segment 56 and the trailing segment 58. The cylindrical openings 90*a*, 90*b* interface with the side surfaces of the trunnion flange 64. The cylindrical openings 90*a*, 90*b* have a tolerance that allows the trunnion flange 64 to pivot about its axis, which allows the vane 28 to pivot. The cylindrical openings 90*a*, 90*b* may act as bearings during operation of the turbine engine 10. The cylindrical openings 82*a*, 82*b*, 90*a*, 90*b* allow the trunnion flange 64 to be recessed such that the flange 64 does not make contact with the channel 50.

Figure 6:
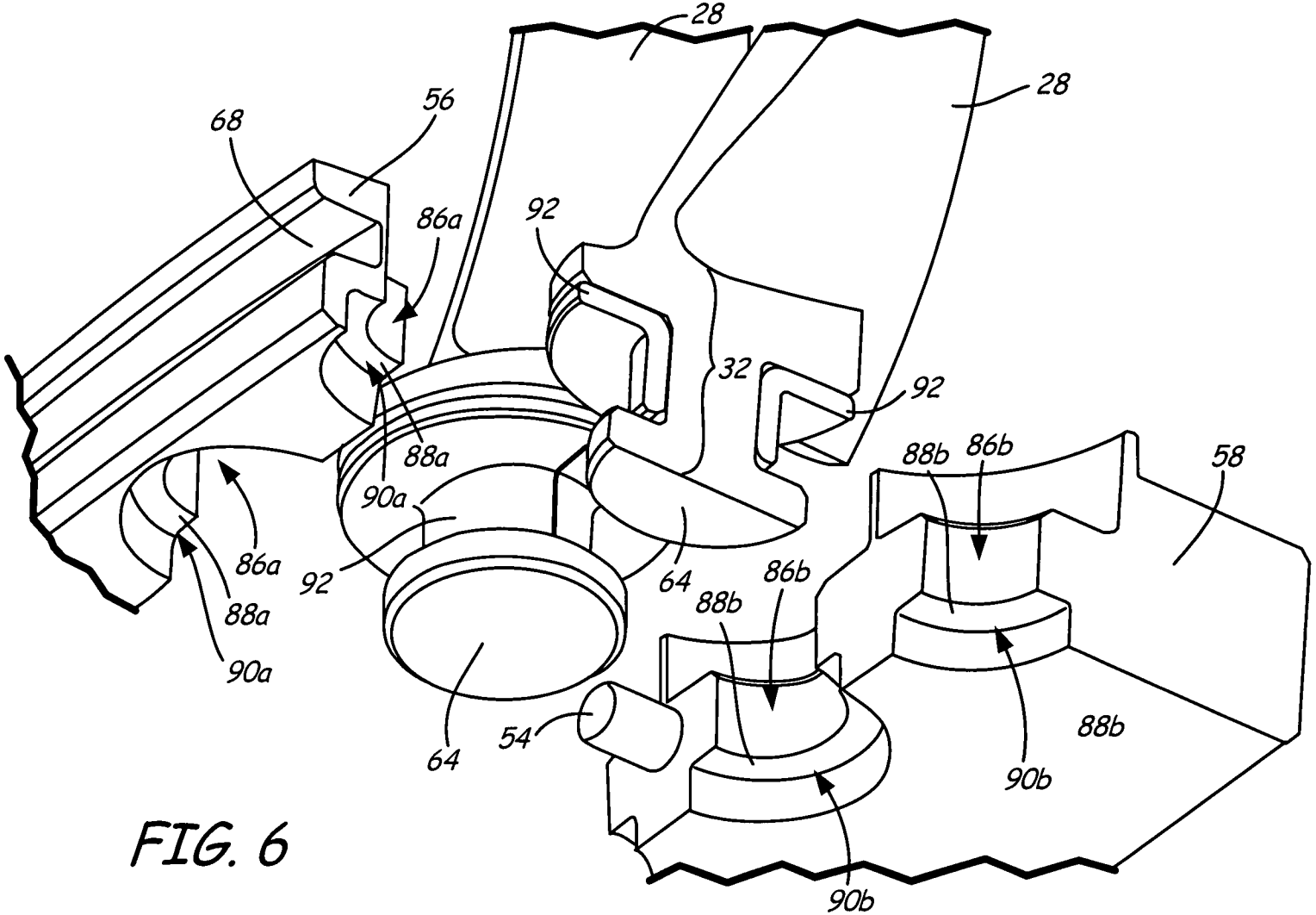
FIG. 6 is an exploded sectional inner diameter view of the shroud assembly core with a composite bearing according to another embodiment of the present invention.

FIG. 6 shows a split bearing 92 that is application specific. It may be used when the core 52 is comprised of a metallic material such as aluminum or a non-metallic such as graphite composite. The split core bearing 92 is comprised of a composite material, and surrounds and interfaces with the base portion 32 of the vane 28. The bearing 92 sits between the metallic core 52 and the base portion 32 during operation of the gas turbine engine 10, and is subject to forces transmitted from the vanes 28 to the base portion 32.

Figure 7:
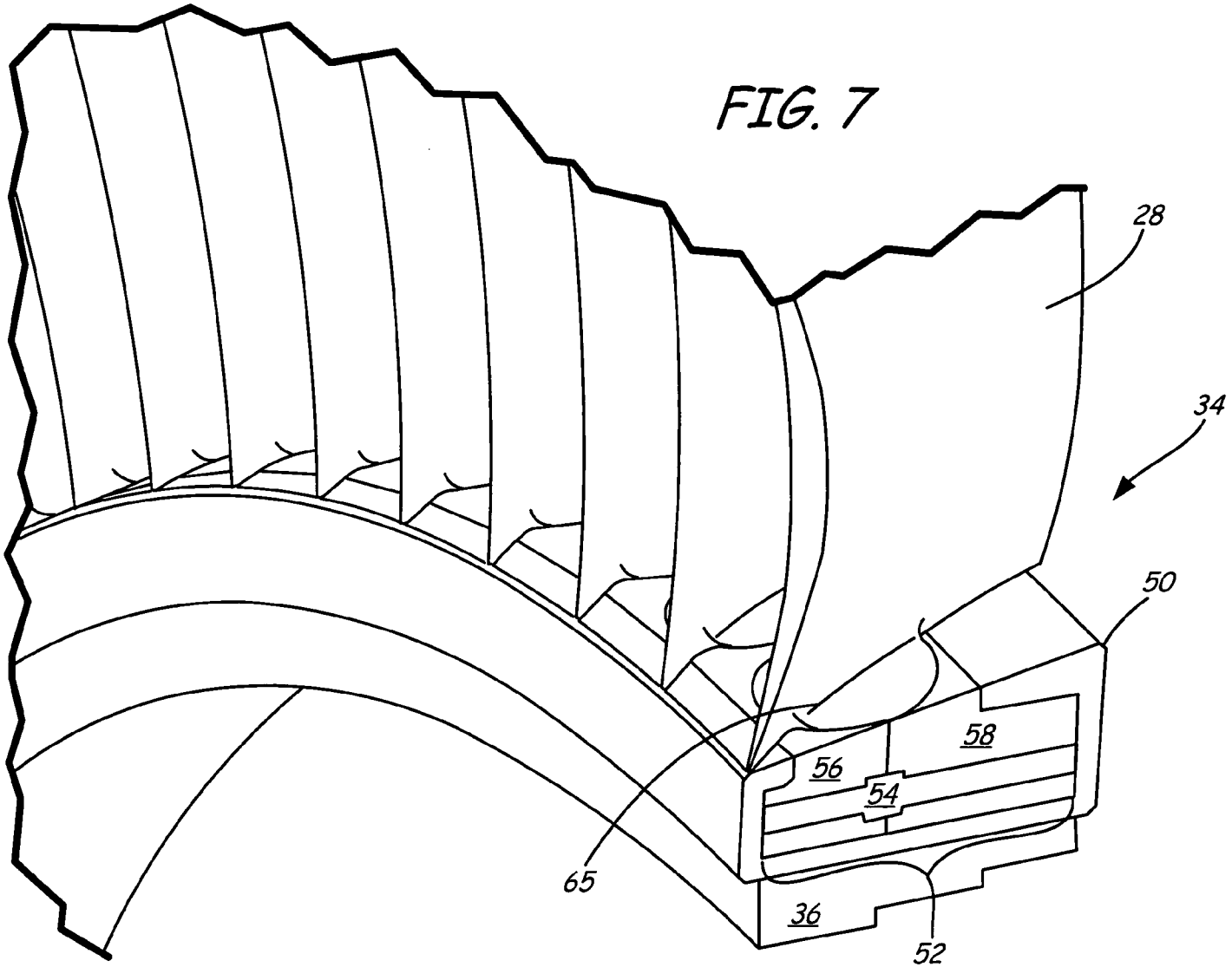
FIG. 7 is a sectional view of a shroud assembly according to another embodiment of the present invention bisecting a dowel pin.
Figure 8:
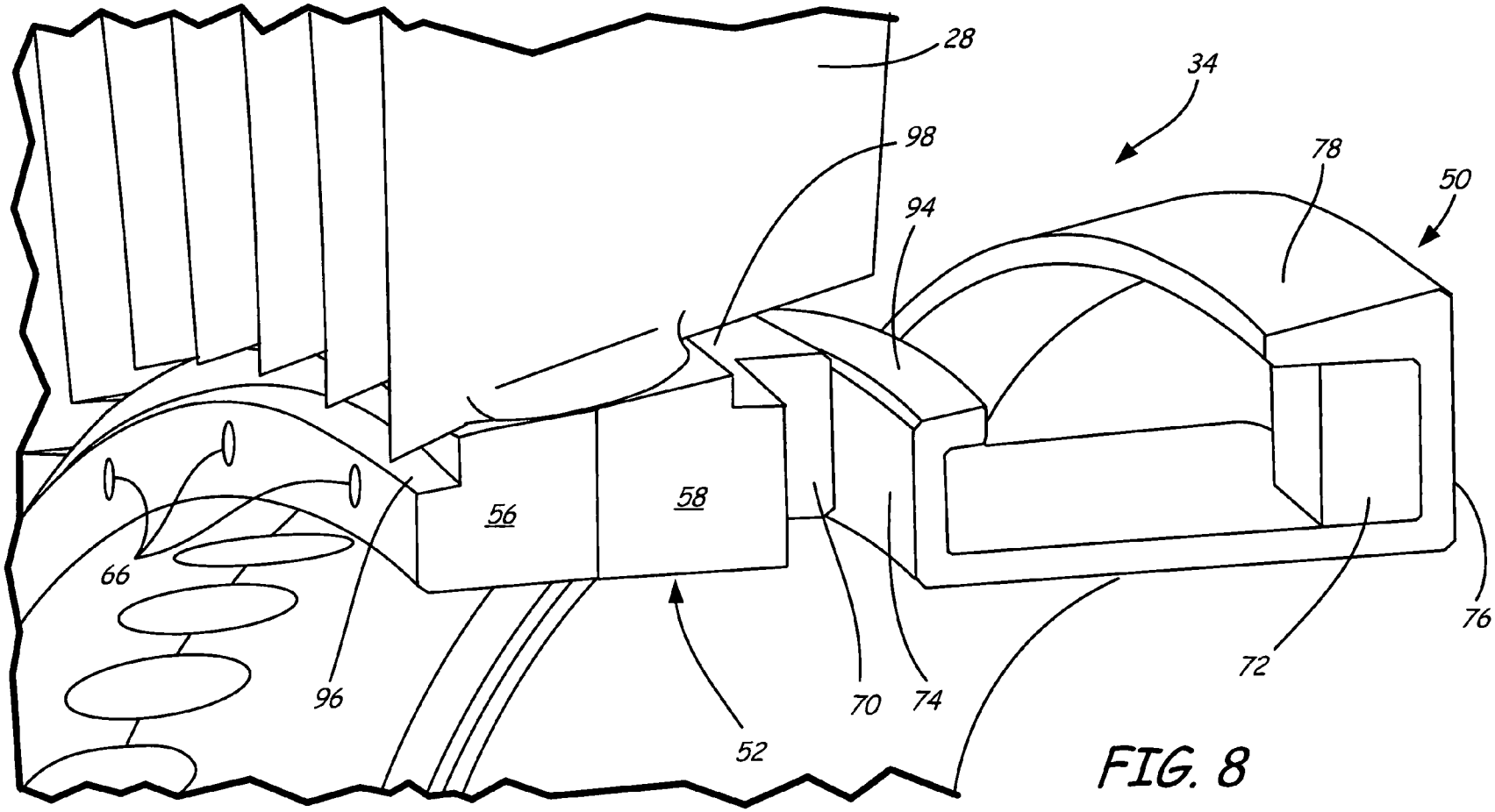
FIG. 8 is an exploded end view of the shroud assembly of FIG. 7 showing a core containing a vane and a channel with an inner air seal removed.

In FIGS. 7 and 8, non-offset leading edge vanes 28 are illustrated inserted in another embodiment of the shroud. In this configuration, the leading edge of the vanes 28 nearly aligns with the leading edge surface 74 of the channel 50 when the channel 50 is inserted over the core 52. The exterior surfaces of the channel 50 and the core 52 act as a seal between the vane 28 and the surfaces to direct the flow along the inner diameter flow path 46.

FIG. 7 also shows a sectional view of another embodiment of the shroud 34 bisecting the dowel pin 54. The dowel pin 54 has a crown around its center. The crown allows the dowel pin 54 to sit on a counter bore. The counter bore is located on an interior surface both the leading segment 56 and the trailing segment 58. The pins 54 fit into a bore hole (or thru hole) aligned with the counter bore to interconnect the leading segment 56 with the trailing segment 58. The bore hole may extend through both the leading segment 56 and the trailing segment 58. The counter bore provides a stop so the dowel pin 54 does not contact the inner surface of the channel 50 through the bore hole. The pins 54 also may be used to align the leading segment 56 with the trailing segment 58 during assembly of the core 52. The pins 54 may be selectively placed between the base portions 32 as required by the engine operating criteria.

FIG. 8 shows an exploded end view of another embodiment of the shroud 34 including the assembled core 52 retaining vanes 28, and the channel 50. In this embodiment, the channel 50 additionally includes a leading edge lip 94. The core 52 additionally includes a first retention track 96 and a second retention track 98.

The leading edge lip 94, forms the external surface of the channel 50 adjacent the leading edge of the shroud 34. The leading edge lip 94 and the trailing edge lip 78 may substantially align with an exterior surface(s) of the core 52 to define the inner diameter flow path 46 annulus for the compressor section of the gas turbine engine 10. The leading edge lip 94 may act as a seal between the vanes 28 and the shroud 34 to direct the flow of air along the inner diameter flow path 46. The leading edge lip 94 also protects the leading segment 56 of the core 52 from particle ingested abrasion.

The first retention track 96 on the leading segment 56 interacts with the leading edge lip 94, and the second retention track 98 on the trailing segment 58 interacts with the trailing edge lip 78 to allow slidable circumferential movement of the core 52 in the channel 50. The leading edge lip 94 retains the leading segment 56 and the trailing edge lip 78 retains the trailing segment 58 from movement into the inner diameter flow path 46 in the radial direction.

Although the present invention has been described with reference to preferred embodiments, workers skilled in the art will recognize that changes may be made in form and detail without departing from the spirit and scope of the invention.

The invention claimed is:

1. An inner diameter shroud for receiving an inner diameter base portion of a rotatable vane in a gas turbine engine comprising:

a single piece channel having a leading edge wall, an inner diameter wall, a trailing edge wall, a radial outer surface, and at least two axial projections;

a core movable in the channel in a circumferential direction and configured to rotatably retain the inner diameter base portion of the rotatable vane, the core separated into two axially abutting segments and being engaged by the axial projections so that the radial movement of the core is prevented;

the core having a radial outer surface that is generally aligned with the radial outer surface of the channel, wherein together the radial outer surface of the core and the radial outer surface of the channel define an inner diameter flow path annulus of the gas turbine engine; and a dowel pin interconnectably aligning the two axially abutting segments of the core;

wherein at least one of the axial projections comprises an interior railhead that retains the core in the radial direction and is not exposed to an inner diameter flow path annulus.

2. The shroud of claim 1, wherein the core is retained in the channel without a fastener.

3. The shroud of claim 1, wherein only one surface of the core is disposed to interface with an inner diameter flow path of a gas turbine engine.

4. The shroud of claim 1, wherein the core is a composite material.

5. The shroud of claim 1, wherein the base portion of the vane is retained by the core such that an outer surface of the base portion generally aligns with the radial outer surface of the core.

6. The shroud of claim 1, further comprising a composite bearing disposed between the base portion of the vane and the core.

7. The shroud of claim 1, wherein a portion of the core is configured to act as a bearing for the base portion of the vane.

8. The shroud of claim 1, wherein the base portion of the vane has a first surface and a second surface, the first surface interconnected to the second surface by a trunnion, the first surface and the second surface subject to a thrust force during operation of a gas turbine engine, the first surface interfaces with a first bearing surface on the core and the second surface interfaces with a second bearing surface on the core.

9. The shroud of claim 1, wherein a radial height of the leading edge wall of the channel is between about 0.250 of an inch to about 0.330 of an inch (about 6.35 mm to about 8.47 mm).

10. The shroud of claim 1, wherein the channel extends through a circumferential arc of substantially 90 degrees in length.

11. The shroud of claim 1, further comprising an inner air seal bonded to a surface of the channel.

12. An inner diameter shroud for receiving an inner diameter base portion of a rotatable vane in a gas turbine engine comprising:

a core, the core having two axially abutting segments, the segments movable in a channel in a circumferential direction and configured to rotatably interface with the inner diameter base portion of the rotatable vane;

the channel retaining the two segments without a fastener, the channel having a leading edge wall, an inner diameter wall, a trailing edge wall, and at least two axial projections for preventing radial movement of the two segments;

wherein a radial outer surface of the core is generally aligned with a radial outer surface of the channel, and wherein together the radial outer surface of the core and the radial outer surface of the channel define an inner diameter flow path annulus of the gas turbine engine; and a dowel pin interconnectably aligning the two axially abutting segments of the core;

wherein at least one of the axial projections comprises an interior railhead that retains the core in the radial direction and is not exposed to the inner diameter flow path annulus.

13. The shroud of claim 12, wherein the core extends through a circumferential arc of substantially 60 degrees in length.

14. The shroud of claim 12, wherein the channel is less than about 14 inches (about 355 mm) in diameter when arrayed circumferentially to interface with an inner diameter flow path of a gas turbine engine.

15. The shroud of claim 12, wherein a radial height of the leading edge wall of the channel is between about 0.250 of an inch to about 0.330 of an inch (about 6.35 mm to about 8.47 mm).

16. The shroud of claim 12, wherein only one surface of each of the abutting portions is disposed to interface with an inner diameter flow path of a gas turbine engine.

17. The shroud of claim 12, wherein a plurality of cores are circumferentially abuttably disposed inside a plurality of circumferentially disposed channels in a high pressure compressor section of the gas turbine engine.

* * * * *